US008348757B2

(12) United States Patent
Kim et al.

(10) Patent No.: US 8,348,757 B2
(45) Date of Patent: Jan. 8, 2013

(54) GAME MACHINE

(75) Inventors: Yong Beom Kim, Incheon (KR); Woon Yong Park, Suwon (KR)

(73) Assignee: Tovis Co., Ltd., Wonju, Gangwon-Do (KR)

( * ) Notice: Subject to any disclaimer, the term of this patent is extended or adjusted under 35 U.S.C. 154(b) by 453 days.

(21) Appl. No.: 12/526,095

(22) PCT Filed: Feb. 6, 2007

(86) PCT No.: PCT/KR2007/000642
§ 371 (c)(1),
(2), (4) Date: Aug. 6, 2009

(87) PCT Pub. No.: WO2008/096916
PCT Pub. Date: Aug. 14, 2008

(65) Prior Publication Data

US 2010/0323791 A1 Dec. 23, 2010

(51) Int. Cl.
*A63F 9/24* (2006.01)

(52) U.S. Cl. ..... 463/30; 463/16; 463/25; 463/42

(58) Field of Classification Search ..... 463/16, 463/25, 30, 42
See application file for complete search history.

(56) References Cited

U.S. PATENT DOCUMENTS 6,346,045 B2 * 2/2002 Rider et al. ..... 463/31
6,712,702 B2 * 3/2004 Goldberg et al. ..... 463/42
6,764,395 B1 * 7/2004 Guyett ..... 463/9
7,384,339 B2 * 6/2008 LeMay et al. ..... 463/30
7,690,979 B2 * 4/2010 Ogiwara ..... 463/17

FOREIGN PATENT DOCUMENTS

JP 10-323447 A 12/1998
JP 2004-73651 A 3/2004
KR 20-0138019 Y1 2/1999
WO WO 2006/033194 A1 3/2006

OTHER PUBLICATIONS

International Search Report of PCT/KR2007/000642 filed on Feb. 6, 2007.

* cited by examiner

*Primary Examiner* — Pierre Eddy Elisca
*Assistant Examiner* — Shahid Kamal
(74) *Attorney, Agent, or Firm* — Kile Park Goekjian Reed & McManus PLLC

(57) ABSTRACT

A user operating the game machine and playing the game can easily transfer the intention of a necessary order or the like to a waiter/waitress, a main counter or the like, without leaving the game machine. Further, the user can check the total input amount for the total of games, the total payout amount, the win percentage per each game, the accumulated win percentage in the total of games. Further, the user can play the game while confirming the information provided in the language selected by the user in real-time, relatively at a glance. Consequently, the game machine is capable of increasing the fun of the game and preventing the user from going beyond a predetermined limit of spending money by being excessively emotionally linked to the game.

13 Claims, 16 Drawing Sheets

GAME MACHINE

TECHNICAL FIELD

The present invention relates to a game machine having a display panel for the games, such as a pachinko game, a reel game, a slot machine game and the like.

BACKGROUND ART

A game machine for entertainment, such as a slot machine, a pachinko machine or a reel machine, is a gambling machine using hard money or its substitute. In the game machine, when a user pulls a lever or presses a switch provided on the game machine, reels containing different patterns of symbols spin or are programmed so that a virtual reel is driven toward a display panel in the front of the game machine by the operation of pressing a button. Then, when symbols match, the game machine pays out the user cash or some other sort of value a predetermined time an input amount and a betting amount.

The aforementioned game machine for entertainment is disclosed in Japanese Patent Publication No. 2004-73651 (Mar. 11, 2004). As illustrated in FIG. 1, the game machine is provided using a general apparatus in which an image is processed toward a display panel 20 in the front of the machine by the light transmitted through a reel 80 positioned inside a cabinet 10; a speaker 40 and a payout displaying window 30 are positioned above the display panel 20; a betting switch 50 and a start switch 51 are positioned at a lower end of the display panel 20 to enable a game; a coin inlet 60 is positioned at a side; and a coin receptacle unit 70 and a coin outlet 71 for providing coins are positioned at a lower part of the cabinet 10.

To use the aforementioned general game machine for entertainment, a user pays a predetermined amount by inserting coins, cash or card into a designated slot. The user continues playing the game by betting money using the remainder of the input amount. While continuously playing the game, the user is very likely to be excessively emotionally linked to the game. As a result, the user unnecessarily spends money and plays the game without being properly aware of the current input amount and win percentage.

Moreover, when the user wants to play the game using the game machine for entertainment, such as the slot machine or pachinko machine, in a foreign country, there are many cases where the language to be selected is usually limited to English. However, when English is not used in the user's language life zone, the user cannot properly operate the game machine and further experiences inconvenience.

Moreover, the business hall where the game machine for entertainment is installed generally has quite a number of game machines. In this hall, when the user of the game machine wants to order, for example, drink, or to order a card for necessary payment or cash for the game, the user has to leave the game machine to call a waiter/waitress. This situation interrupts the game or causes a trouble in using the game machine.

DISCLOSURE

Technical Problem

Therefore, the present invention has been made to solve the above problems, and it is an aspect of the present invention to provide a game machine which displays detailed information, such as the total amount being input by a user and the win percentage while the user plays the game using the game machine, so that the user enjoys the game while being provided with the game-related information in real-time or so.

It is another aspect of the present invention to provide a game machine which enables the user to select a language used in the user's language life zone as the language to be displayed on the game machine, so that the user is provided with a comfortable environment that he/she feels as if he/she enjoys the game in his/her own country even though he/she plays the game in a foreign country.

It is another aspect of the present invention to provide a game machine which makes it easy for the user to call a waiter/waitress for various services inside a hall, to prevent any troubles that may be caused when the user leaves the game machine more frequently than it is necessary.

It is another aspect of the present invention to provide a game machine in which a keyboard panel to operate the game machine is structurally changed to display various information images and the like through an input switch of the keyboard panel, so that the game machine has visual splendor.

Technical Solution

In accordance with the present invention, the above and other aspects can be accomplished by a game machine comprising: an LCD keyboard panel comprising: a button section with a number of input switches used to operate the game machine by a user to display a game image; a menu section for performing a language selection, an order, a call and the like; an explanation section for displaying an explanation loaded according to the button section and the menu section and providing a sub-menu selected by the user; and an individual information display section for displaying the user's game information in the rear of the LCD keyboard panel.

Accordingly, the game machine makes it possible for the user to play the game while easily checking the necessary information for the game, such as the total win percentage, the remaining amount, the total input amount, the win percentage in each game, the accumulated win percentage in the total of games, and the like. The game machine further makes it possible for the user to select the language to be used on the LCD keyboard panel, so that the user can relatively conveniently use the game machine. The game machine further makes it easy for the user to call a waiter/waitress or to ask a desired service in the hall, so that the inconvenience that the user experiences when using a conventional game machine is solved.

Advantageous Effects

In accordance with the present invention, the user operating the game machine and enjoying the game can easily transfer his/her necessary order to a waiter/waitress, a main counter or the like, without leaving the game machine. Furthermore, the user plays the game while in real-time checking, relatively at a glance, in each game, the total input amount and the total payout amount through the total of games, the win percentage per game and the accumulated win percentage through the total of games which are provided in the familiar language selected by the user. Therefore, the game machine increases the user's interest in the game and prevents the user from going beyond a predetermined limit of spending money when he/she is excessively emotionally linked to the game.

DESCRIPTION OF DRAWINGS

These and other aspects and advantages of the present invention will become apparent and more readily appreciated from the following description of the embodiments, taken in conjunction with the accompanying drawings, in which.

BEST MODE

In accordance with an embodiment of the present invention, a game machine which includes a display section for displaying a game image in the front of the game machine under an advertisement panel section positioned at an upper position of the game machine and in which proceeds a game by operating a button when cash or card is acknowledged, comprises: an LCD keyboard panel including a button section with a number of input switches for operating the game machine, and an explanation section for displaying an explanation corresponding to the operation of the button section.

In accordance with another embodiment of the present invention, a game machine which includes a display section for displaying a game image in the front of the game machine under an advertisement panel section positioned at an upper position of the game machine and which proceeds a game by operating a button when cash or card is acknowledged, comprises: an OLED keyboard panel including a button section with a number of input switches for operating the game machine, and an explanation section for displaying an explanation corresponding to the operation of the button section, wherein the OLED keyboard panel uses an OLED obtained by removing a polarizing plate so that a brightness value decreasing with the passage of use time is corrected to be a constant brightness value by adjusting a voltage and a current.

Mode for Invention

Hereinafter, embodiments of the present invention will be described in detail with reference to the accompanying drawings.

The present invention provides an LCD keyboard panel or an OLED keyboard panel comprising a lever or a protruding button for operating a game in a game machine for entertainment, such as a slot machine, a pachinko machine, a reel game machine or the like. The present invention further provides the constitution extended from an end of the LCD keyboard panel or the OLED keyboard panel and received in a receiving section under a display section of the game machine, to display the user's game information during the game. The present invention further provides the constitution to make it possible for the user to call a waiter/waitress or to order necessary goods, without leaving the game machine, so that the user is provided with a desired service.

The present invention further provides the constitution to maximally slim the entire thickness of the LCD keyboard panel.

Figure 7:
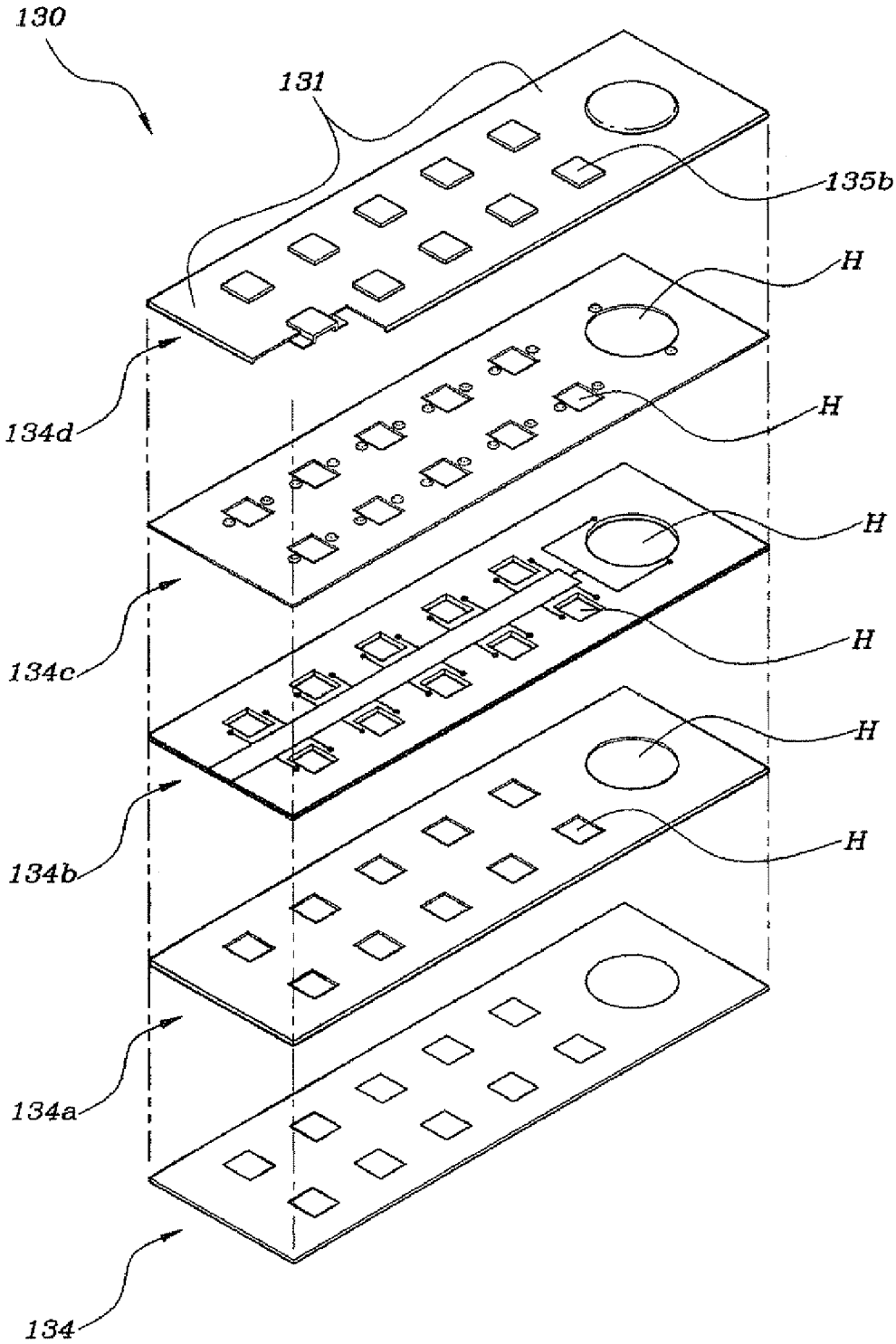
FIGS. 7 and 8 are a separate perspective view and a sectional view illustrating an example of a keyboard panel applied to the present invention.
Figure 8:
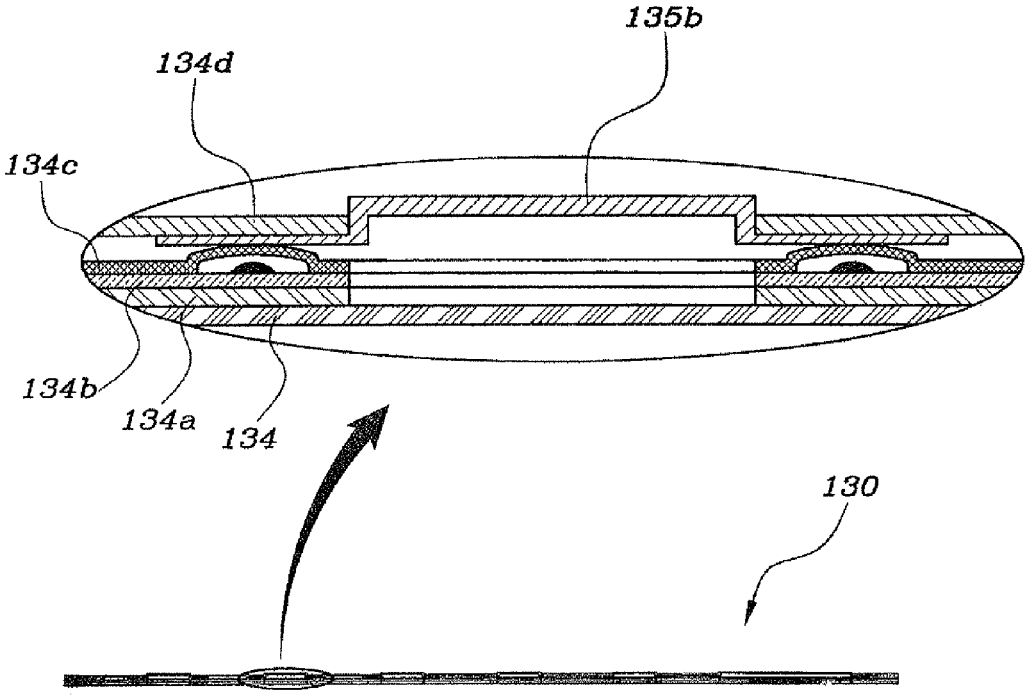
Figure 9:
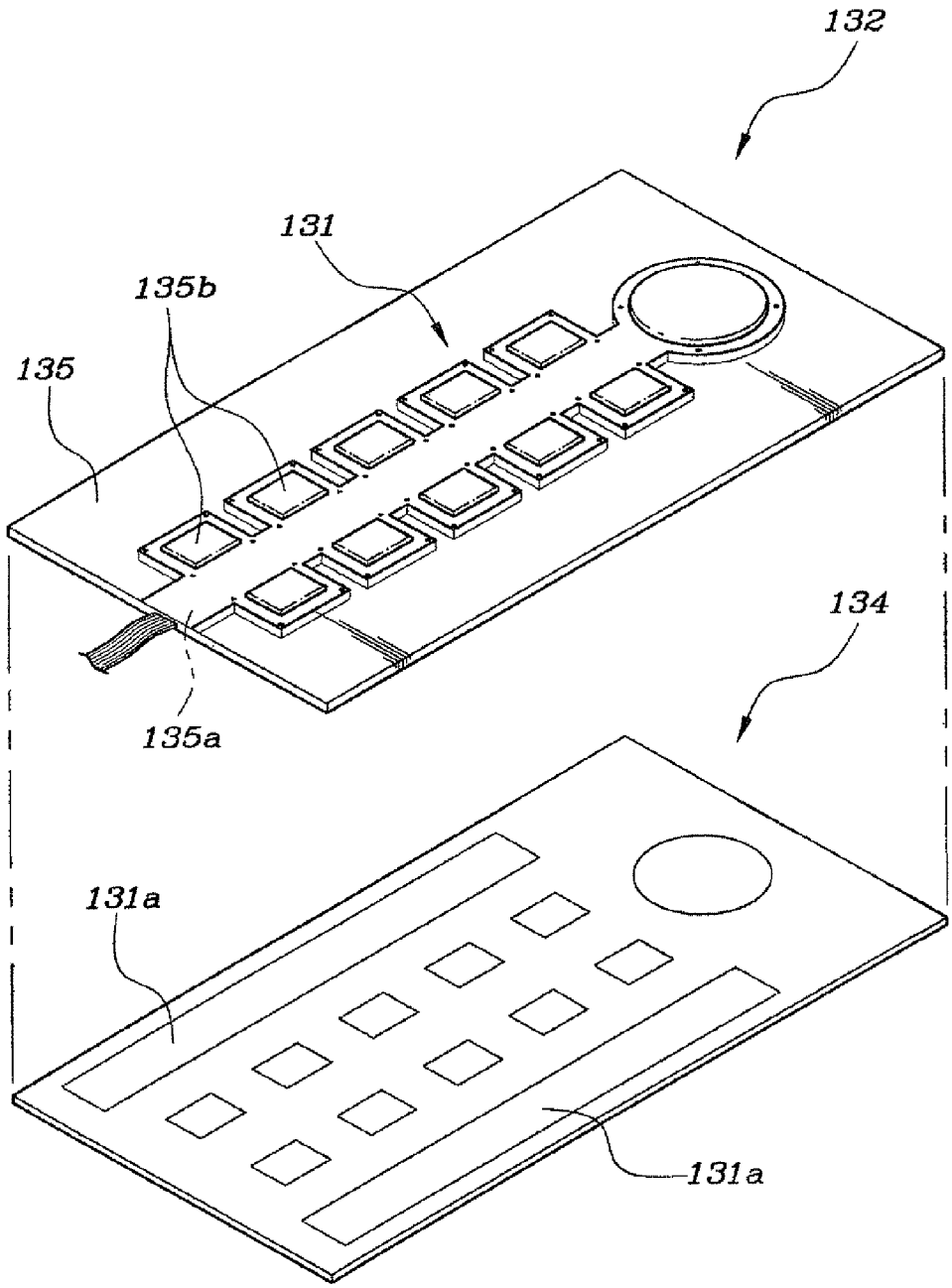
FIG. 9 is a separate perspective view illustrating an LCD keyboard panel applied to the present invention.
Figure 10:
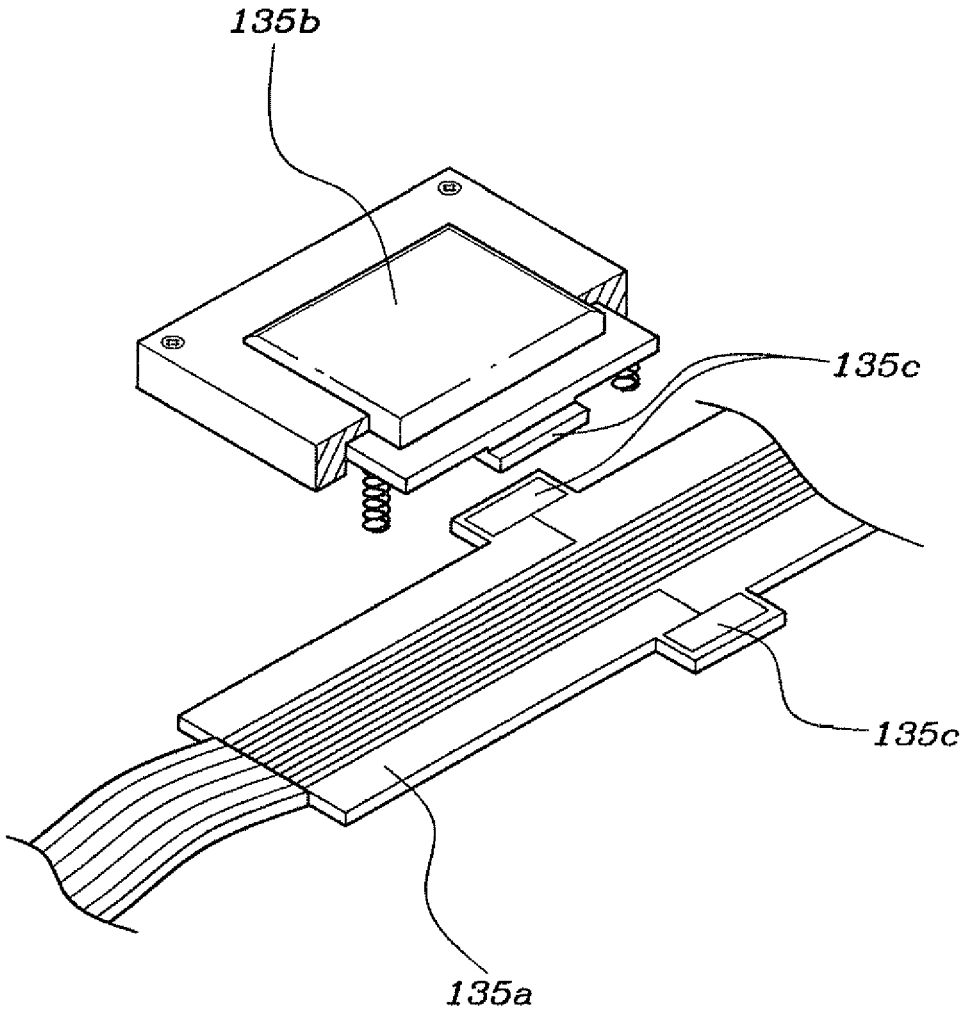
FIG. 10 is a partially cut and enlarged perspective view illustrating an example of an input switch applied to the LCD keyboard panel of FIG. 8.
Figure 11:
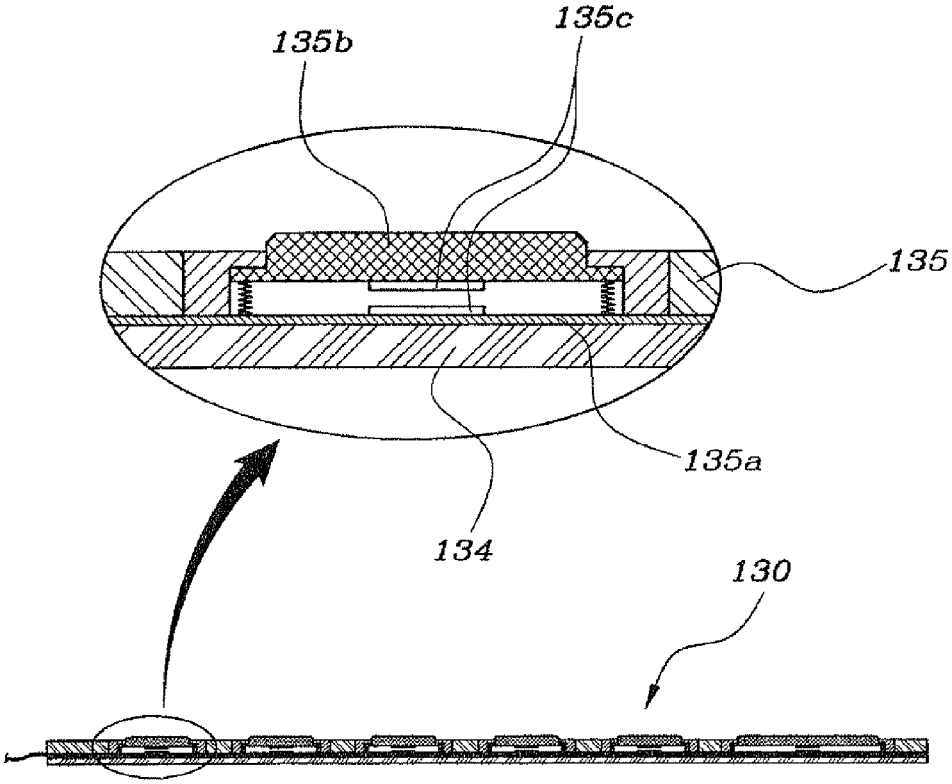
FIG. 11 is a sectional view of FIG. 9.
Figure 12:
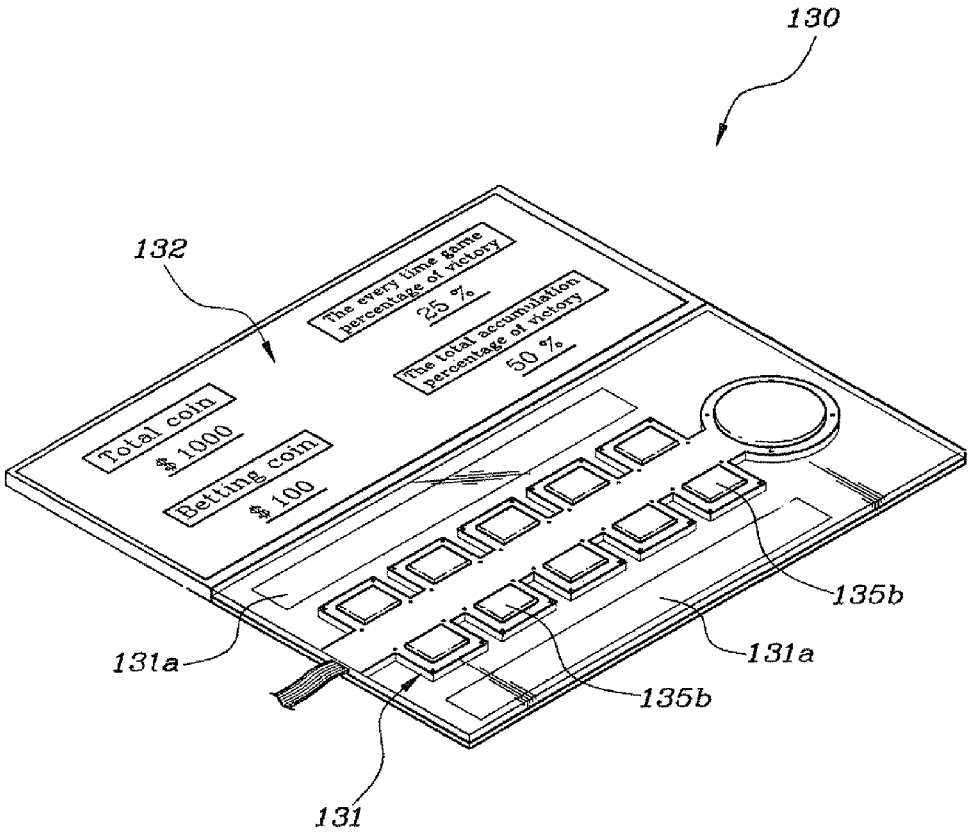
FIG. 12 is a perspective view illustrating an LCD keyboard panel having an individual information display panel extended from the rear of the LCD keyboard panel of FIG. 9.
Figure 13:
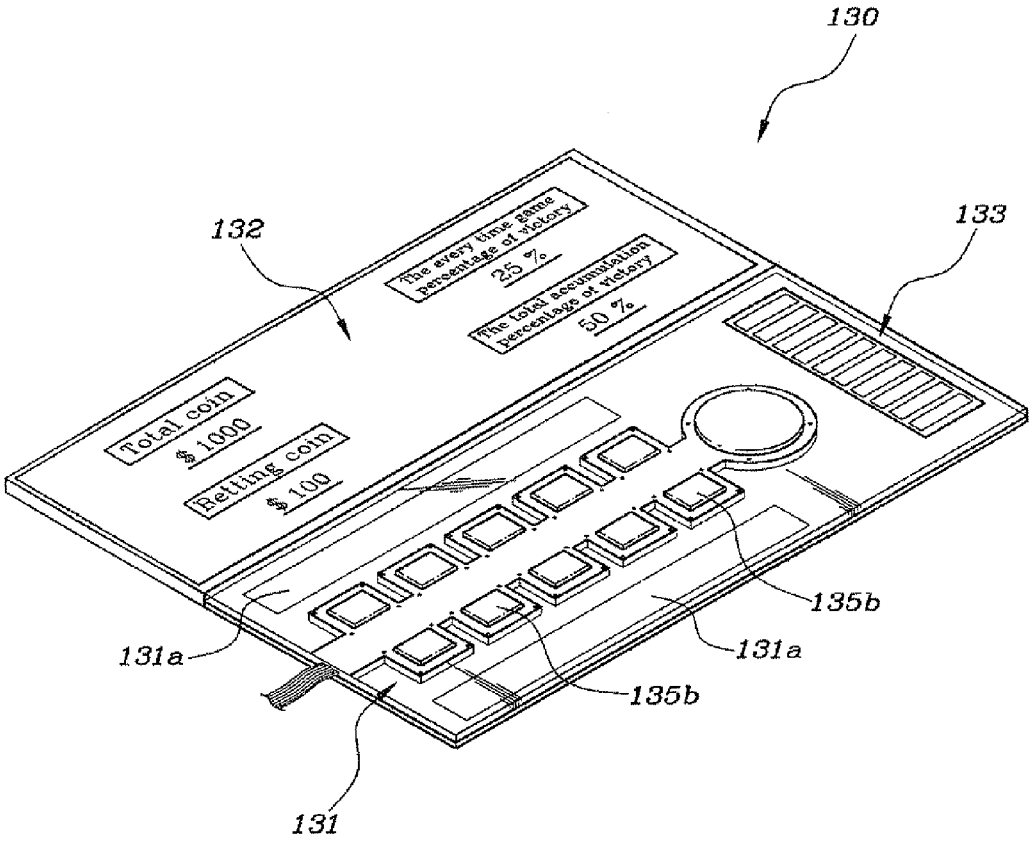
FIG. 13 is a perspective view illustrating a menu section structured at one side of the LCD keyboard panel.

To manufacture a slim LCD keyboard panel 130 to operate a game machine 100 according to the present invention, as illustrated in FIGS. 7 and 8, a thin-film steel plate 134*a* is positioned on an LCD panel 134, a polyester film PCB 134*b* is positioned on the steel plate 134*a*, and a rubber plate 134*c* and an upper steel plate 134*d* are positioned on the polyester film PCB 134*b*, wherein the upper steel plate 134*d* has a button section 131 in which a number of input switches 135*b* are arranged.

Each input switch 135*b* has a transparent body. An aperture H is bored in the region corresponding to each input switch 135*b*. That is, the aperture H is board through the corresponding regions of the steel plate 134*a*, the polyester film PCB 134*b* and the rubber plate 134*c*.

Through the aperture H, the information or the like to be displayed on the LCD panel 134 positioned at the lowest position of the LCD keyboard panel 130 is transmitted to be projected to the user through the input switch 135*b* of the upper steel plate 134*d*.

That is, when the user presses the input switch 135*b*, a contact of the polyester film PCB 134*b* which is the thin film under the rubber plate 134*c* has a short circuit by the rubber plate 134*c* under the corresponding input switch 135*b*, to display the corresponding information through the LCD panel 134. Then, the information is transmitted through the aperture H formed in the relevant region of the steel plate 134*a*, the polyester film PCB 134*b* and the rubber plate 134*c*, to be displayed to the user through the input switch 135*b* of the upper steel plate 134*d*.

Further, as illustrated in the drawings, the game machine 100 comprises a display section 110, a receiving section 120 and an LCD keyboard panel 130. A lower end part of the display section 110 is sectionalized to form the receiving section 120 with an open front. The LCD keyboard panel 130 includes an individual information display section 132 to be received inside the receiving section 120.

As illustrated in FIGS. 9 through 13, the LCD keyboard panel 130 comprises a button section 131 to be operated by the user to play a game. The user operates the button section 131, to control the betting and to start each game.

Figure 14:
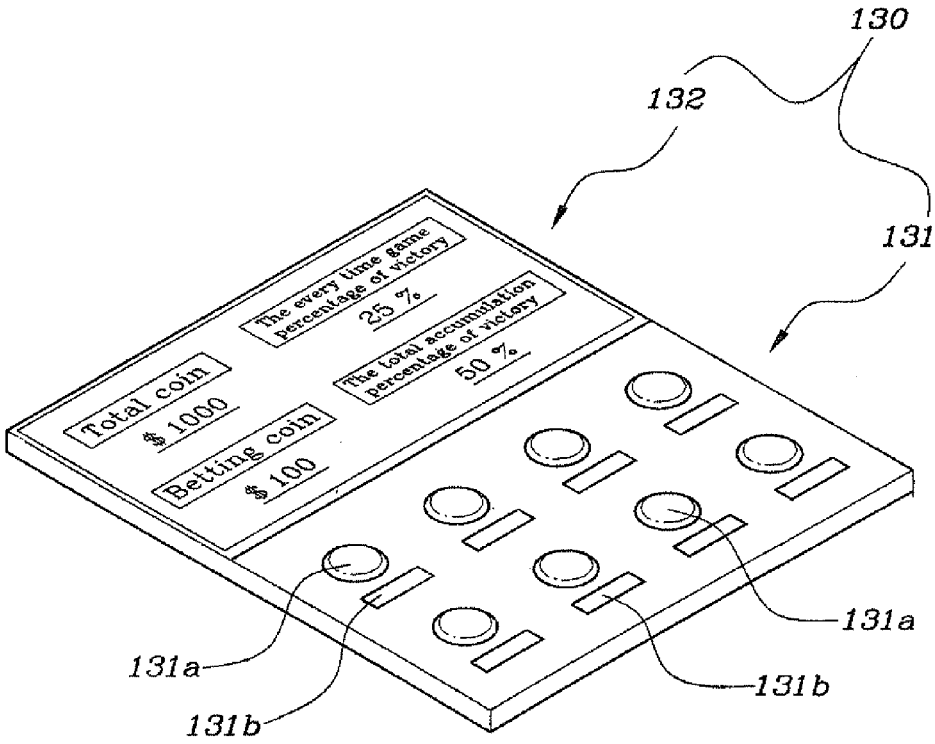
FIGS. 14 and 15 are perspective views respectively illustrating LCD keyboard panels according to other modified examples of the embodiment of the present invention.
Figure 15:
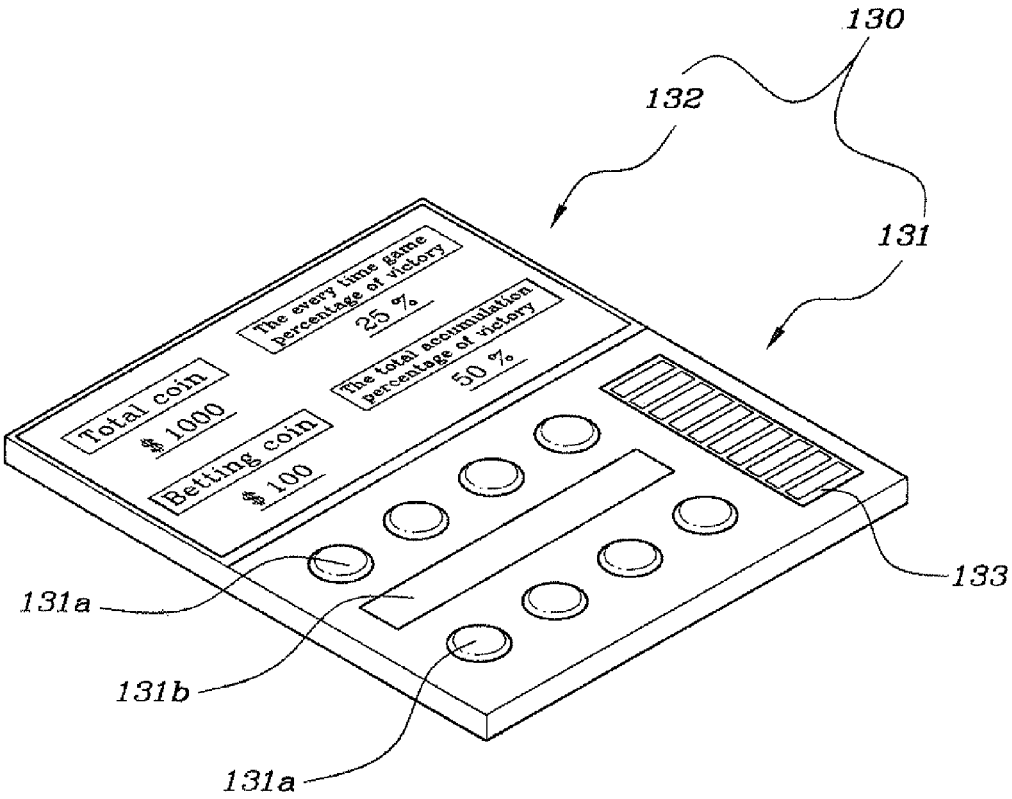
Figure 16:
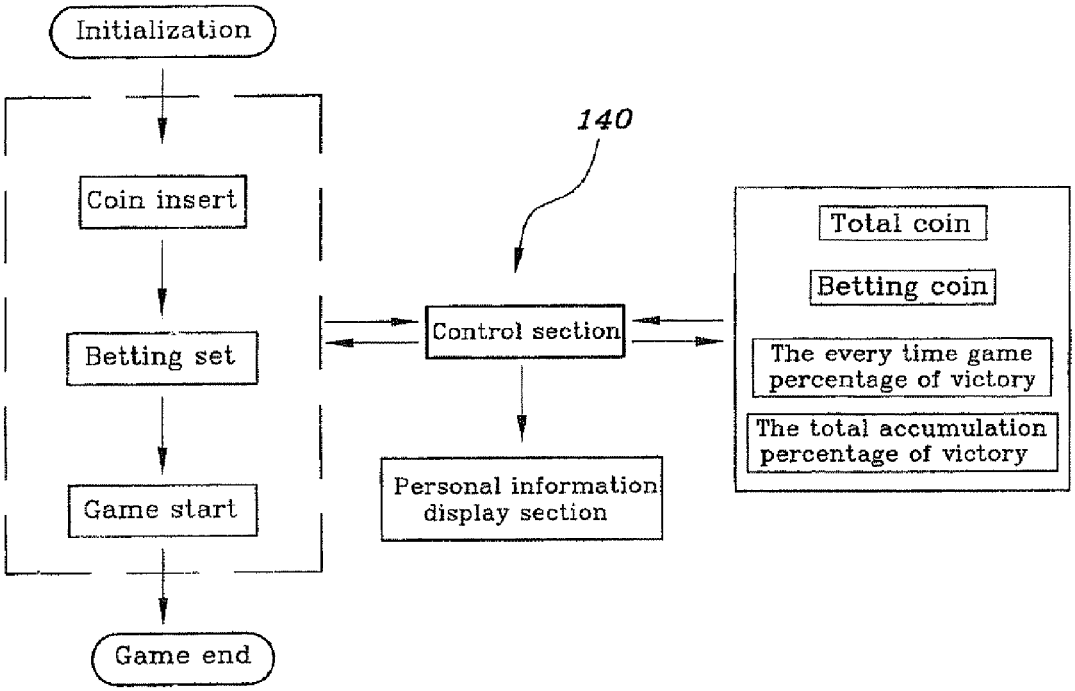
FIG. 16 is a block diagram illustrating an individual information display section and a control flow during the game using the game machine according to the present invention.

Further, as illustrated in FIG. 14, the button section 131 may have a number of buttons 131*a* and include an explanation section 131*b* explaining a function of each button 131*a* under the button 131*a*.

The explanation section 131*b* may add an explanation of each button 131*a*, an explanation of the game to be selected, and the like.

The LCD keyboard panel 130 can be slimed in its thickness by the above-described structure or the structure according to other embodiments which will be described later.

The button section 131 may be operated by applying a touch panel mode using a screen touch, a press mode, or various button operation modes.

Further, the explanation section 131*b* may display a sub-menu by a control section 140, wherein the sub-menu is relevant to an item selected from a menu section 133 which will be described later. Preferably, the sub-menu may be realized such that a desired sub-menu is selected by the touch pad mode and loaded.

Preferably, the menu section 133 may include various functional menu buttons which can be selectively applied by the user, for example, a language conversion button for converting the language, which is displayed on the display section 110, the explanation section 131*b*, the advertisement panel section 150 and the like of the game machine 100, into the user's native language, or a button for calling a counselor of a counter or a waiter/waitress so that the user is able to order necessary goods, cash, card or the like during the game.

When the user selects the language conversion in the menu section 133, the language, which is used for displaying diverse information through the explanation section 131*b* of the LCD keyboard panel 130, the display section 110 of the game machine 100, the advertisement panel section 150 positioned above the display section 110 and displaying various advertising descriptions, call descriptions or the like, and the individual information display section 132 to be described later, is converted into the language selected by the user, so that the information is displayed in the selected language.

Language data, language translation data, translation program and the like for the language conversion selected from the menu section 133 may be realized by a program loaded in the control section 140 of the game machine 100.

For example, when the user is not a native speaker of a language basically used in the game machine 100, he/she can select the language conversion from the menu section 133 included in the LCD keyboard panel 130, to select his/her native language so as to be used in the game machine 100. Then, the explanation section 131*b* displays the sub-menu providing a number of languages to be selected. When the user selects his/her language, the basically used language in the display section 110 of the game machine 100, the explanation section 131*a* of the LCD keyboard panel 130, the individual information display section 132 formed by extending form one side of the LCD keyboard panel 130 and displaying the individual information, and the advertisement panel section 150 positioned at the upper position in the front of the game machine 100 and displaying various advertising descriptions or waiter/waitress call descriptions, is translated into the language selected by the user and the selected language is displayed by the translation program loaded in the control section 140.

Accordingly, the game machine 100 having the above-described constitution provides the environment that even a foreigner can enjoy the game as if he/she does so at his/her home and further prevents any loss that might be caused when the foreign user misunderstands the other language than his/her own language.

Further, when the user selects an order in the menu section 133, the goods for order are displayed through the explanation section 131*a*. Then, when the user selects a desired item from the displayed goods, the selected item is displayed on the counter or the advertisement panel section 150 of the game machine 100. Preferably, the user may receive the desired service, without leaving the game machine 100.

Further, when the user wants to call a waiter/waitress, a counselor or the like to receive a payout amount, to play other games or to need any special services, the user selects the call from the menu button 133, to transfer his/her intention.

To transfer his/her intention, a call signal may be sent to the advertisement panel section 150 through the control section 140 operatively connected to the menu section 133, or it may be output by a call lamp 151 additionally positioned on the top of the game machine 100.

FIGS. 9 through 13 illustrate the LCD keyboard panel 130 applied to the present invention.

As illustrated in the drawings, the LCD keyboard panel 130 according to the present invention comprises a transparent plate 135 with a PCB 135*a* positioned at a bottom. The transparent plate 135 is positioned on the LCD panel 134. The transparent plate 135 includes a number of input switches 135*b*.

The input switches 135*b* included on the transparent plate 135 are in the form of buttons. On the transparent plate 135, a region corresponding to each input switch 135*b* is bored so that the input switch 135*b* is interposed. The PCB 135*a* is positioned at the bottom of the transparent plate 135 lengthwise. The contact of the PCB 135*a* and each input switch 135*b* has a short circuit by the operation of the input switch 135*b*. A signal by the contact-based communication is sent to the control section 140, so that diverse information is displayed through the LCD panel 134 positioned under the transparent plate 135.

Reference number 135*c* indicates a contact section of the input switch 135*b* contacts with the PCB 135*a* when the input switch 135*b* is pressed.

The input switches 135*b* are arranged on the transparent plate 135, to input the information.

The input switches 135*b* may have the same structure as a generally well-known keyboard. Each input switch 135*b* comprises a transparent body like the transparent plate 135. When the input switch 135*b* is pressed, a signal is transmitted to the control section 140 through the contact section 135*c* connected to the PCB 135*a*, to display the relevant information within the region of the relevant input switch 135 of the LCD panel 134.

Accordingly, when the input switch 135*b* is operated, the diverse information, for example, the information by light or characters (English, Japanese, Chinese, Korean and others), is displayed through the region of the LCD panel 134 under the relevant input switch 135*b* and is outwardly projected through the relevant input switch 135*b*.

Unlike a conventional game machine using the input switch 135*b* for the pressing operation, the game machine 100 according to present invention displays the image information or light having diverse information through each button of the input switch 135*b*. As a result, the game machine 100 provides the user with visual variation and diverse information through each input switch 135*b* of the LCD keyboard panel 130.

The press of the input switch 135*b* may be perceived by a switch or a sensor.

That is, the press of the input switch 135*b* can be sensed by including a photo sensor (not shown) in the input switch 135*b* or applying a touch pad on the LCD panel 134.

The LCD keyboard panel 130 having the above-described structure may comprise the individual information display section 132 for displaying diverse information obtained during the game. The individual information display section 132 is inserted into the receiving section 120 positioned under the display section 110 of the game machine 100. The menu section 133 may be also included at a side of the LCD keyboard panel 130.

Further, the LCD keyboard panel 130 may use an organic light-emitting diode (OLED) resulting by removing a polarizing plate, to approach the brightness of the LCD keyboard panel 130 to a value being same as or similar to the aforementioned LCD panel. Then, preferably, a constant brightness value may be continuously maintained, without decreasing the brightness, by adjusting a voltage and a current to correct the brightness value which decreases with the passage of use time.

Specifically, the present invention uses the OLED incorporating the organic light emitting materials which generate strong light of various colors when a direct current is applied between electrodes, to have the constant luminous intensity and to significantly prolong the use life of the game machine.

For example, in the LCD panel to which the polarizing plate is applied, the basic luminous intensity is typically 200 candelas. However, when the OLED obtained by removing the polarizing plate is applied like the present invention, the brightness is brighter about two times the case where the polarizing plate is applied, based on the same candelas.

The term, candela ?is one of the basic units adopted under the international system (SI) of units, which is a basis for optical measurement. When radiant intensity of a light source which emits monochromatic light with the frequency of $540\times10^{12}$ Hz is 1/683 watt per solid angle (steradian: sr) in a given direction, the candela means the luminous intensity of the given direction.

That is, when the polarizing plate constituting a part of the OLED is removed, the brightness is brighter by about two times. Then, even though the voltage and current provided to reduce the applied candelas (for example, 200 candelas) are decreased by a half, the LCD keyboard panel 130 has the constant brightness.

Further, after the brightness rapidly decreases as the use time increases, the brightness edges along. Then, the brightness is corrected by increasing the relevant voltage and current at proper candelas, so that the original brightness can be maintained. Therefore, the same effect as that of correcting the brightness value of the LCD keyboard panel 130 is expected.

When the above-described correction of the brightness is made, the game machine 100 is capable of displaying at the constant brightness while maintaining relatively less candelas. As a result, it is confirmed that the power consumption is significantly reduced and the use life is prolonged about twice.

The individual information display section 132 displays the total amount that the user inputs into the relevant game machine 100, the current remainder, the win percentage in each game, the current situation of a payout, the betting amount in the relevant game, the total game time, and the like. That is, the diverse information obtained using the relevant game machine 100 is displayed to the user.

Then, as described above, the user can select the language to be used in the individual information display section 132 as the language that the user can easily understand.

That is, the control section 140 perceives the total input amount into the game machine 100, the used/paid amount, the betting amount in the relevant game, whether or not a payout after the game, and other information, automatically operates the win percentage, and the like, and displays the diverse information through the individual information display section 132, to be provided to the user. Accordingly, since the current information is provided to the user in real-time, the game machine 100 is capable of inducing the user to play the game at proper costs and time.

Further, the internal structure of the receiving section 120 for receiving the individual information display section 132 may vary according to embodiments of the present invention.

Figure 4:
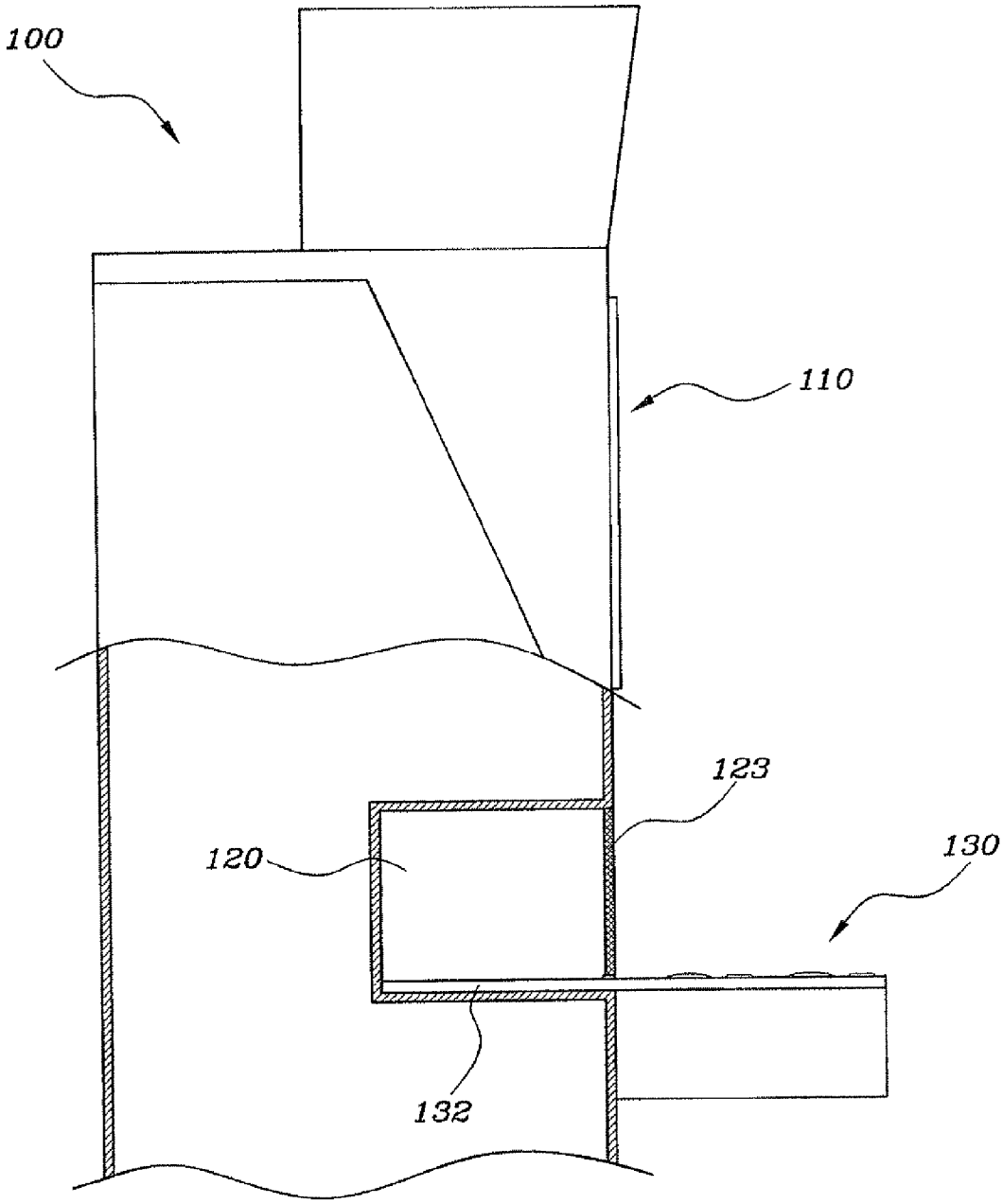
FIG. 4 is a schematic sectional view illustrating a game machine according to another embodiment of FIG. 3.

For example, as illustrated in FIG. 4, a transparent glass 123 permitting an image to be transmitted is positioned in the front of the receiving section 120. The user can easily confirm the image information from the individual information display section 132, using the transparent glass 123.

Figure 5:
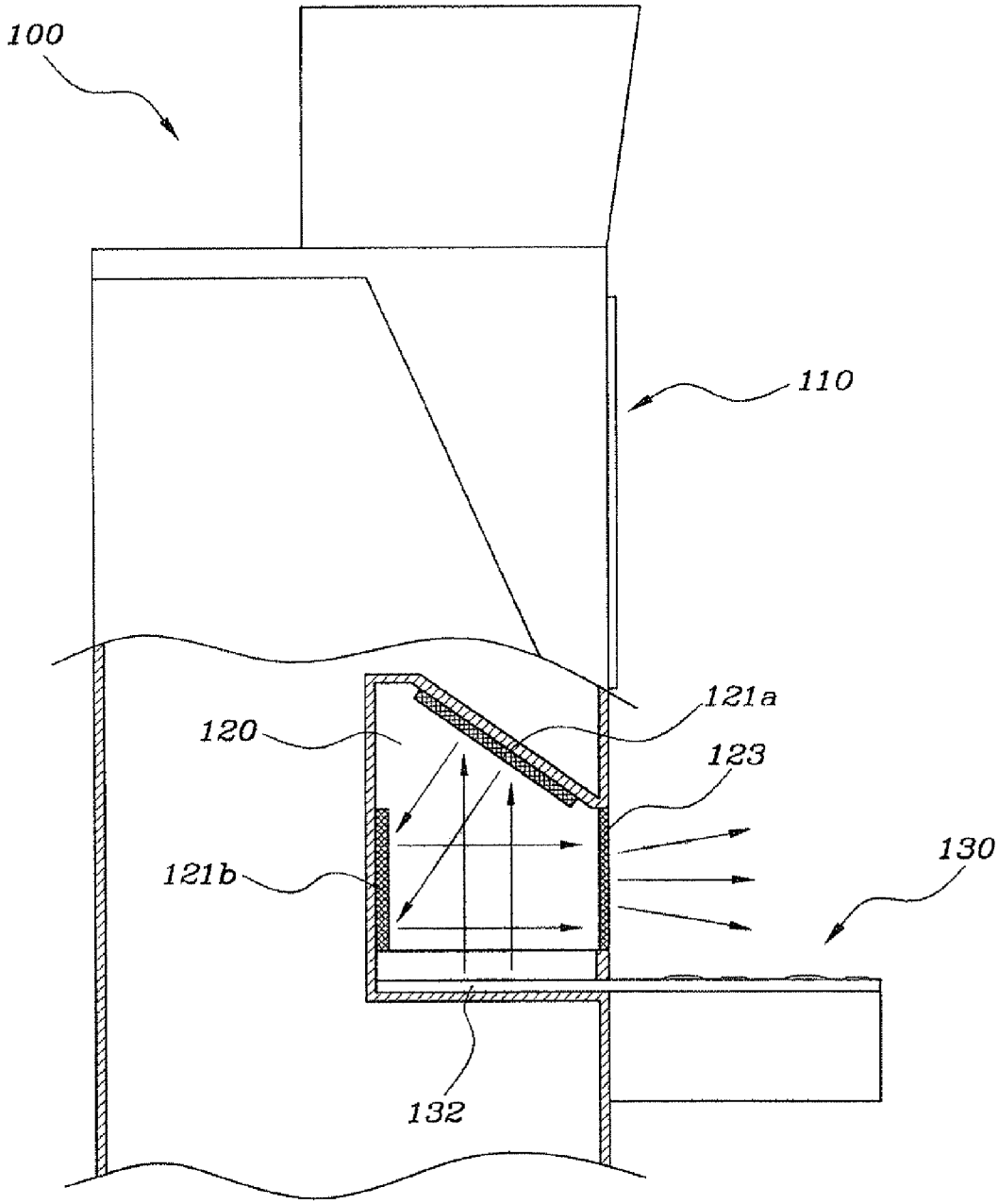
FIG. 5 is a schematic sectional view illustrating a game machine according to another embodiment applying FIG. 4.
Figure 6:
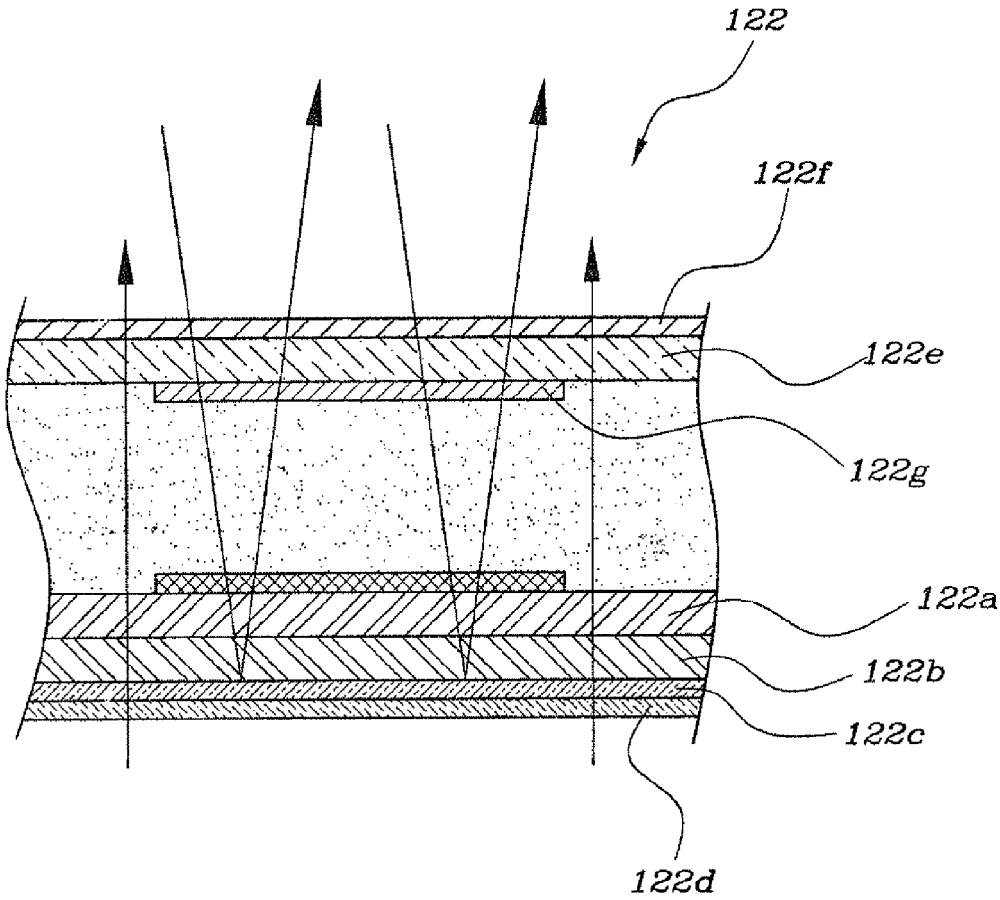
FIG. 6 is a sectional view illustrating an example of a transparent retro-reflection sheet panel applied to the present invention.

Unlike the receiving section 120 of FIG. 4, the receiving section 120 illustrated in FIG. 5 may comprise a first mirror 121*a* and a second mirror 121*b*. The first mirror 121*a* is positioned to be fixedly titled at an upper position of the receiving section 120 and the second mirror 121*b* reflects the image reflected in the first mirror 121*a*.

Therefore, when the image, such as diverse information, which is displayed from the individual information display section 132 of the LCD keyboard panel 130 is reflected in the first mirror 121*a* positioned to be fixedly tilted at the upper position of the receiving image 120, the image is reflexive to be forwardly reflected in the second mirror 121*b* being positioned to be fixedly inserted inside the receiving section 120. That is, the image is again reflected to be transmitted through the transparent glass 123 covering the front side of the receiving section 120, so that the image is displayed to the user.

Figure 1:
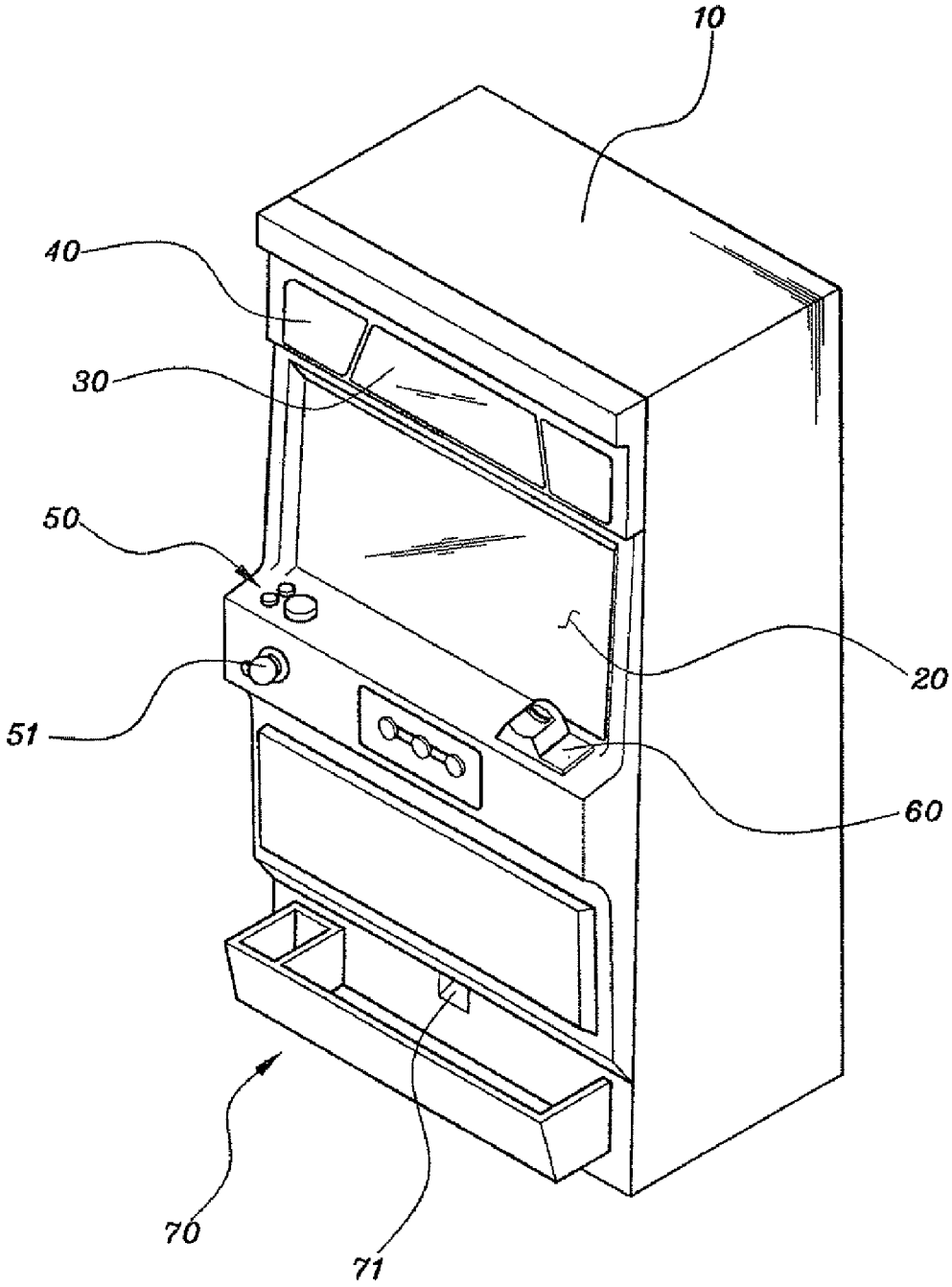
FIG. 1 PRIOR ART
FIG. 1 is a perspective view illustrating a conventional game machine.
Figure 2:
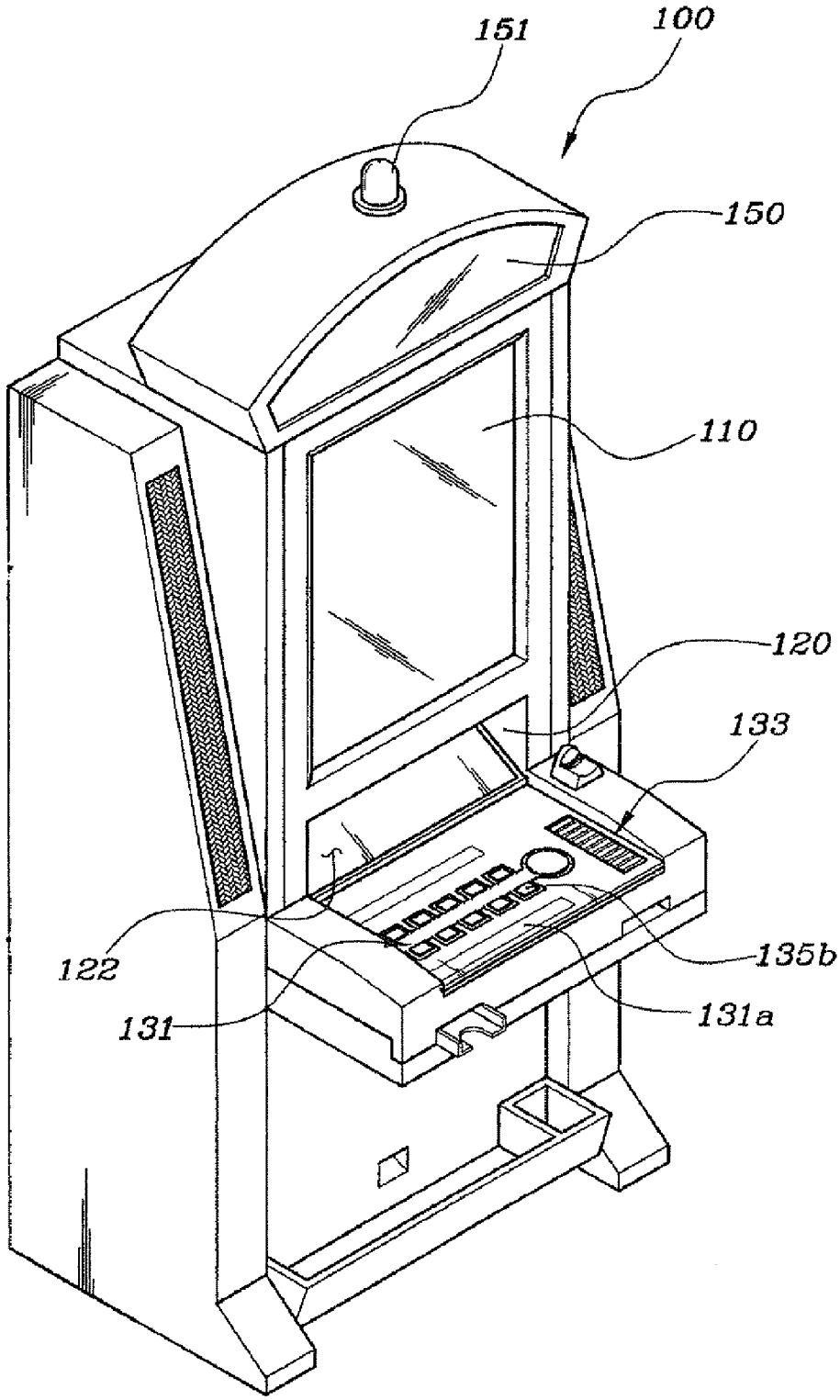
FIG. 2 is a perspective view illustrating a game machine to which the present invention is applied.
Figure 3:
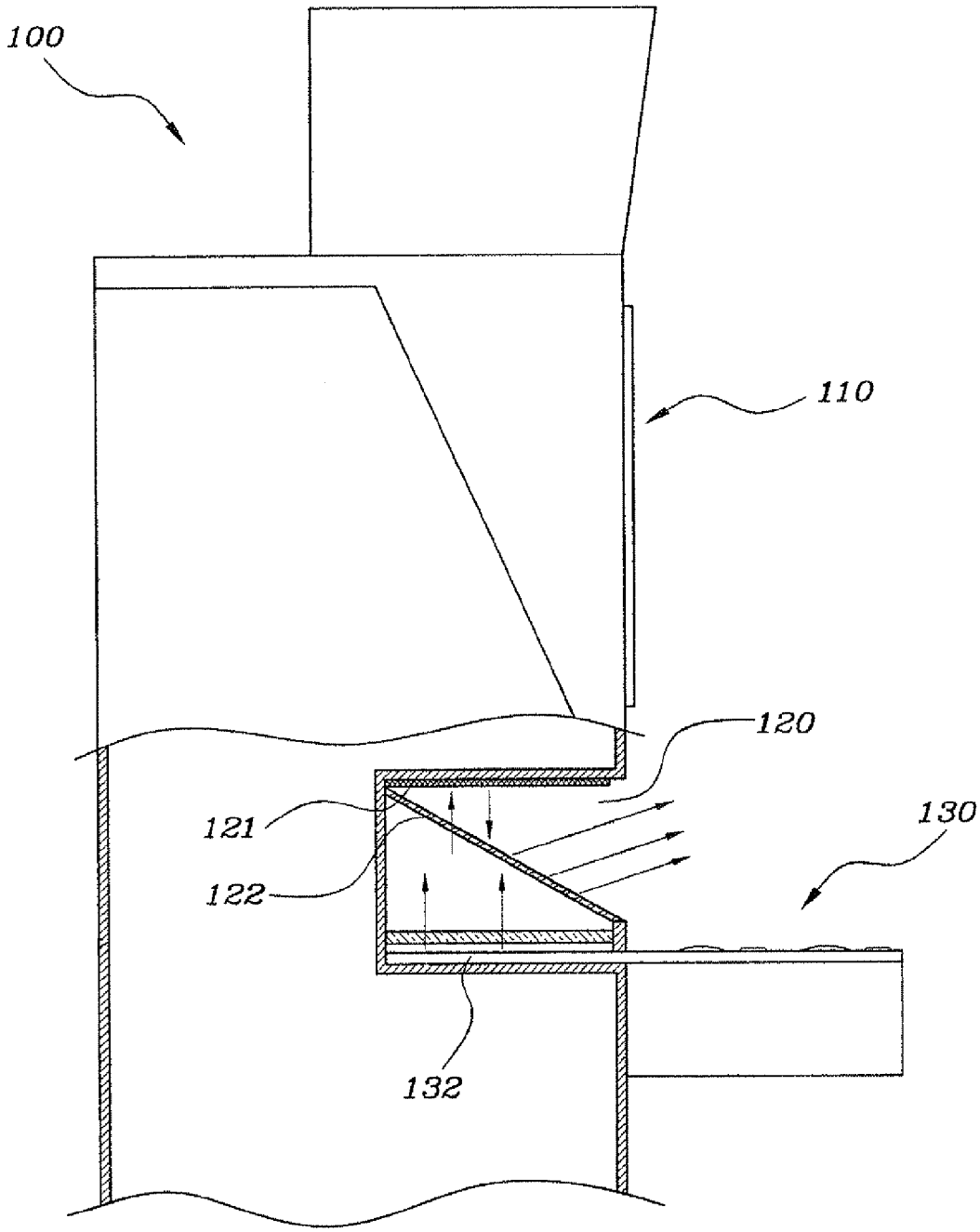
FIG. 3 is a schematic sectional view illustrating the game machine of FIG. 2 according to an embodiment of the present invention.

Further, the user can confirm the image information of the individual information display section 132 in the receiving section 120 according to another embodiment. As illustrated in FIG. 3, the individual information display section 132 is included inside the receiving section 120 as described above. The receiving section 120 may comprise a mirror 121 and a transparent retro-reflection sheet panel 122. The mirror 121 is positioned at the under side of the top of the receiving section 120. The transparent retro-reflection sheet panel 122 crosses in a diagonal direction, to partition the receiving section 120.

The mirror 121 is to reflect the information which is displayed through the individual information display section 132. The transparent retro-reflection sheet panel 122 is to again reflect the information reflected and displayed through the mirror 121, to be displayed so that the user can visually confirm the information.

The information image displayed in the individual information display section 132 needs to be capable of being transmitted through the transparent retro-reflection sheet panel 122 which crosses the receiving section 120 in the diagonal direction. Therefore, the information image, such as individual information, can be transmitted to the mirror 121 positioned at the directly upward position through one side of the transparent retro-reflection sheet panel 122, i.e., the bottom side of the transparent retro-reflection sheet panel 122 in relation to FIG. 3. However, the other side of the transparent retro-reflection sheet panel 122 which is again retro-reflected through the mirror 121 does not allow light to be transmitted and is reflected to be displayed to the user.

The transparent retro-reflection sheet panel 122 may use a well-known sheet panel, to have the aforementioned characteristics.

For example, the transparent retro-reflection sheet panel 122 is formed by positioning a first polarizing plate 122*b* transmitting only the light in a specific direction under a TFT substrate 122*a*, positioning a second reflecting plate 122*c* coated with a $TiO_2$ film which is a dielectric thin film under the first polarizing plate 122*b*, positioning a first reflecting plate 122*d* coated with a $SiO_2$ film which is a dielectric thin film under the second polarizing plate 122*c*, positioning a second polarizing plate 122*f* on a color filter substrate 122*e* which is the upper substrate of the panel, and forming a color pattern 122*g* on the TFT substrate 122*a* and under the color filter substrate 122*e*.

The transparent retro-reflection sheet panel 122 having the above-described constitution is realized according to the embodiment of the present invention. The transparent retro-reflection sheet panel 122 may be realized according to various embodiments.

The individual information and the game information which are displayed through the individual information display section 132 are reflected in the mirror 121 and re-reflected on the surface of the transparent retro-reflection sheet panel 122, to be displayed to the user.

As described above, the transparent retro-reflection sheet panel 122 is positioned diagonally. Thus, since the angle of inclination of the transparent retro-reflection sheet panel 122 is parallel to the angle of view of the user who is seated in front of the game machine 100, the game machine 100 can relieve the tiredness of the eyes of the user.

When the game is proceeded using the game machine 100 according to the present invention, such as a slot machine including a reel game or the like, the button section 131 of the LCD keyboard panel 130 may be clicked to reset the game machine 100 through the control section 140, according to an initial set signal of the control section 140.

Then, when the language conversion button in the menu section 133 positioned at one side of the LCD keyboard panel 130 is used to select the language suitable for the user, the language, which is displayed in the advertisement panel section 150, the display section 110 positioned in the front of the game machine 100, the individual information display section 132 extended from the LCD keyboard panel 130 and received into the receiving section 120, the button section 131, and the explanation section 131*a* displaying the game explanation in the LCD keyboard panel 130, is converted into and displayed in the user's desired language through the program of the language translation machine or the like which is loaded in the control section 140.

After the game machine 100 is reset to the initial set at the optimal conditions for use, the user inputs cash or available card into the game machine 100, to pay a proper amount and operates the button section 131 of the game machine 100 to play the game every time. The control section 140 operates the betting amount per game, the payout amount after the game, the win percentage as a result of each game, and the like, to display the operated information per item through the individual information display section 132 of the LCD keyboard panel 130 received in the receiving section 120 under the display section 110.

The displayed individual information related to the game is displayed to the user through the individual information display panel 132 positioned to be inserted inside the receiving section 120.

Further, when the user wants to exchange cash or card using money if necessary or to order drink, food or necessary goods through the waiter/waitress in the hall, the user may call the waiter/waitress by pressing the call button included in the button section 131 of the LCD keyboard panel 130, through the advertisement panel section 150 at the upper part in the front of the game machine 100.

Then, the waiter/waitress call mode may send the counselor of the main counter the item to be ordered, with the call signal. Alternatively, the order request may be made by displaying the call signal and the item to be ordered through the advertisement panel section 150 in the front of the game machine 100.

For example, when the user of the game machine 100 calls a waiter/waitress or a counselor to ask the requirements since the user wants to order drink, to exchange money, to replace the game machine due to any problems and/or to call the concerned person for a jack pot, the user may touch the button meeting each requirement so that the requested order is displayed in the selected language on the advertisement panel section 150 or the user may clearly transfer his/her requirements to the waiter/waitress or counselor of the main counter by using the call lamp 150. The call lamp 150 may have various colors to indicate a different color for each order situation.

INDUSTRIAL APPLICABILITY

As described above, in accordance with the game machine of the present invention, the convenience is maximally secured during the game, irrespective of the nationality of the user/gamer operating the game machine. Therefore, the demand for the game machine according to the present invention increases in the entertainment hall and thus the mass-production of the game machines and the sale possibility thereof are secured. Therefore, the present invention has the sufficient industrial applicability by the mass-production of the standardized game machine.

The invention claimed is:

1. A game machine which includes an advertisement panel section positioned at an upper position in front of the game machine, and a display section for displaying a game image positioned under the advertisement panel section and in which a game proceeds by operating a button after cash or card is acknowledged, comprising:

a keyboard panel including a button section with a number of input switches to operate the game machine, and an explanation section for displaying an explanation corresponding to the button section as operated, a receiving section formed between the display section the keyboard panel, the receiving section being formed at an inward part of the game machine, and an individual information display section extended from one side of the keyboard panel, the individual information display section being disposed inside the receiving section, wherein the keyboard panel comprises:

a display panel divided into image regions and sectionalized to display an image to be set in the image regions by operating the input switches, a steel plate as a thin film to cover the top surface of the display panel, a polyester film PCB (printed circuit board) safely positioned on the steel plate, a rubber plate stacked on the polyester film PCB (printed circuit board), and an upper steel plate covering the top surface of the rubber plate and including the button section with the input switches being arranged, and wherein the regions of the rubber plate, polyester film PCB (printed circuit board) and the steel plate corresponding to the regions of the upper steel plate where the input switches are each positioned respectively include an aperture and are connected together so that the apertures are aligned, wherein the advertisement panel section comprises:

a call lamp turned on as the menu section of the keyboard panel is operated suitably for the user's requirements for an order for drink, a call for a waiter/waitress, a call for a jack pot and the like, wherein the call lamp is displayed in different colors to distinguish the conditions for the call from one another.

2. The game machine according to claim 1, wherein when an input switch of the button section is operated, an image to be displayed through a display panel included at the bottom of the keyboard panel is transmitted through the input switch.

3. The game machine according to claim 1, wherein the keyboard panel further comprises:

a menu section capable of performing a language selection, an order for goods and a call; and an explanation section displaying an explanation corresponding to the button section and the menu section as operated and providing a sub-menu loaded from the button section and the menu section and selected by a touch pad.

4. The game machine according to claim 1, wherein the keyboard panel further comprises:

a transparent plate positioned on a display panel and including a PCB (printed circuit board) positioned on the bottom surface of the transparent plate in which the input switches are positioned.

5. The game machine according to claim 4, wherein each input switch is interposed in a hole bored through the region corresponding to the input switch assigned on the transparent plate and is structured to have a short circuit of a contact as the PCB (printed circuit board) and the input switches are operated, so that a signal based on contact communication is transmitted to project relevant information through the corresponding divided region under the input switch on the display panel under the bottom side of the transparent plate and the information is displayed through the input switch outwardly.

6. The game machine according to claim 4, wherein the input switch being pressed is sensed by using a switch, a sensor, a photo sensor or a touch pad on the display panel.

7. The game machine according to claim 1, wherein the receiving section is structured to be open in its front and comprises:

a transparent retro-reflection sheet panel positioned to diagonally cross inside the receiving section and to divide an internal space of the receiving section; and a mirror positioned at an upper surface of the receiving section.

8. The game machine according to claim 1, wherein the receiving section comprises a transparent glass positioned in the front of the receiving section, to transmit the information image transferred from the individual information display panel.

9. The game machine according to claim 1, wherein the receiving section comprises:

a first mirror positioned to be fixedly tilted upwardly at an upper surface of the receiving section; and a second mirror positioned to re-reflect an image reflected in the first mirror.

10. The game machine according to claim 1, wherein the individual information display section displays a control section operation results on an amount of money being input into the game machine, an amount of a payout, a win percentage in each game, and a win percentage in the total of games.

11. The game machine according to claim 3, wherein the menu section comprises a number of touch pad buttons for selecting a language conversion, a order and a counter call, and the explanation section displays a sub-menu corresponding to the selected menu and loaded by the control section, so that the information is displayed in the language selected by the user, the goods order and the counter call are enabled according to each selection of the user.

12. The game machine according to claim 1, wherein the keyboard panel is an LCD keyboard panel or an OLED keyboard panel.

13. The game machine according to claim 1, wherein the display panel is an LCD panel or an OLED panel.

* * * * *